US010343810B1

(12) United States Patent
Schumaker et al.

(10) Patent No.: US 10,343,810 B1
(45) Date of Patent: Jul. 9, 2019

(54) TISSUE CARTON

(71) Applicant: Kimberly-Clark Worldwide, Inc., Neenah, WI (US)

(72) Inventors: Jason John Schumaker, Hortonville, WI (US); Gretchen Sarah Koch, Hortonville, WI (US); Brandon Mark Hokanson, Sheboygan Falls, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 15/884,841

(22) Filed: Jan. 31, 2018

(51) Int. Cl.

| | |
|---|---|
| ***B65D 5/02*** | (2006.01) |
| ***A47K 10/18*** | (2006.01) |
| ***B65D 83/08*** | (2006.01) |
| ***B65D 3/08*** | (2006.01) |
| *A47K 10/42* | (2006.01) |

(52) U.S. Cl.
CPC ..... *B65D 5/02* (2013.01); *A47K 10/18* (2013.01); *B65D 3/08* (2013.01); *B65D 83/0805* (2013.01); *A47K 10/421* (2013.01)

(58) Field of Classification Search
CPC ..... B65D 5/02; B65D 3/08; B65D 83/0805; B65D 83/0894; B65D 5/0209; B65D 5/029; B65D 5/16; B65D 5/425; A47K 10/18; A47K 10/42; A47K 10/185; A47K 10/421
USPC ..... 229/132, 106, 122; D9/734, 431; 221/33, 305, 65; 206/233
See application file for complete search history.

(56) References Cited

U.S. PATENT DOCUMENTS

| | | | | |
|---|---|---|---|---|
| 2,050,894 A * | 8/1936 | Eaton | B65D 5/029 229/108 |
| 4,513,862 A | 4/1985 | Mallow | |
| 4,623,074 A * | 11/1986 | Dearwester | A47K 10/421 206/494 |
| 5,219,421 A | 6/1993 | Tipping | |
| D372,396 S | 8/1996 | Seager | |
| D391,847 S | 3/1998 | Seo | |

(Continued)

FOREIGN PATENT DOCUMENTS

| | | |
|---|---|---|
| CH | 136273-0001 S1 | 9/2009 |
| CH | 136273-0002 S1 | 9/2009 |

(Continued)

OTHER PUBLICATIONS

Copending U.S. Appl. No. 29/635,472, filed Jan. 31, 2018, by Schumaker et al. for "Tissue Carton".

*Primary Examiner* — Christopher R Demeree
(74) *Attorney, Agent, or Firm* — Kimberly-Clark Worldwide, Inc.

(57) ABSTRACT

The present disclosure provides a novel blank for producing cartons, particularly cartons useful for storing and dispensing sheets of tissue, having a novel shape. The cartons have at least one corner edge that is partially formed from an edge wall having a convex cross-sectional shape. In certain instances the carton has four corners and each of the edges is at least partially formed from an edge wall having a convex cross-sectional shape. By providing a carton having one or more convex shaped corner edges not only is a disinvite carton created, but the additional wall forming the convex edge may be provided with graphics that differ from the other carton walls to further enhance the cartons distinctive appearance.

18 Claims, 6 Drawing Sheets

(56) References Cited

U.S. PATENT DOCUMENTS

| | | | | |
|---|---|---|---|---|
| D394,385 | S | 5/1998 | Laughlin | |
| 6,182,418 | B1 | 2/2001 | McFarland | |
| D459,221 | S | 6/2002 | Springer et al. | |
| D464,566 | S | 10/2002 | Anchor | |
| D473,464 | S | 4/2003 | Anchor | |
| 6,588,626 | B2 * | 7/2003 | Sauer | A47K 10/42 206/494 |
| 6,672,475 | B1 * | 1/2004 | Ho | B65D 83/0847 221/45 |
| D513,177 | S | 12/2005 | Tachikawa et al. | |
| D514,437 | S | 2/2006 | Kim | |
| D514,928 | S | 2/2006 | Keberlein | |
| D519,832 | S | 5/2006 | Demathieu | |
| D521,376 | S | 5/2006 | Mosto | |
| D553,496 | S | 10/2007 | Martuch et al. | |
| D589,343 | S | 3/2009 | Bohache | |
| D598,745 | S | 8/2009 | Bohache | |
| D697,789 | S * | 1/2014 | Gerdes | D9/417 |
| D702,565 | S | 4/2014 | Gale | |
| D714,638 | S | 10/2014 | Mohn | |
| D728,364 | S | 5/2015 | Baker et al. | |
| D754,534 | S | 4/2016 | Sanfilippo | |
| D768,475 | S | 10/2016 | Thompson | |
| D775,520 | S | 1/2017 | Stephens | |
| D775,946 | S | 1/2017 | Ghini | |
| D787,934 | S | 5/2017 | Bore | |
| D830,165 | S | 10/2018 | Thompson et al. | |
| D834,411 | S | 11/2018 | Vanderhulst et al. | |
| 2002/0175094 | A1 | 11/2002 | Campbell et al. | |
| 2006/0049067 | A1 | 3/2006 | McDonald | |
| 2006/0049074 | A1 * | 3/2006 | Long | B65D 83/0805 206/494 |
| 2006/0102644 | A1 * | 5/2006 | Long | B65D 83/0805 221/63 |
| 2008/0210704 | A1 | 9/2008 | Lomg et al. | |
| 2018/0148216 | A1 | 5/2018 | Stephens et al. | |

FOREIGN PATENT DOCUMENTS

| | | | |
|---|---|---|---|
| CH | 136273-0003 | S1 | 9/2009 |
| CH | 136273-0004 | S1 | 9/2009 |
| CH | 136273-0005 | S1 | 9/2009 |
| CN | 301121855 | | 1/2010 |
| CN | 30210635 | S | 10/2012 |
| EM | 000575253-0007 | S | 10/2008 |
| EM | 000575253-0009 | S | 10/2008 |
| EM | 001155832-0001 | S | 8/2009 |
| EM | 001155832-0002 | S | 8/2009 |
| EM | 001155832-0003 | S | 8/2009 |
| EM | 001155832-0004 | S | 8/2009 |
| EM | 001155832-0005 | S | 8/2009 |
| EM | 001584228-0001 | S | 8/2009 |
| EM | 001584228-0002 | S | 8/2009 |
| EM | 002560946-0001 | S | 12/2014 |
| EM | 002560946-0002 | S | 12/2014 |
| EM | 002560946-0003 | S | 12/2014 |
| EM | 002560946-0004 | S | 12/2014 |
| EM | 002560946-0005 | S | 12/2014 |
| EM | 002560946-0006 | S | 12/2014 |
| EM | 002652131-0002 | S | 3/2015 |
| IN | 218719-0001 | S | 2/2010 |
| MX | 029926-0001 | S | 2/2010 |
| WO | D070763-001 | S | 2/2009 |
| WO | D070763-002 | S | 2/2009 |
| WO | D084304-001 | S | 3/2015 |
| WO | D084304-002 | S | 3/2015 |
| WO | D084304-003 | S | 3/2015 |
| WO | D084305-001 | S | 3/2015 |
| WO | D084305-002 | S | 3/2015 |
| WO | D084305-003 | S | 3/2015 |
| WO | D084305-004 | S | 3/2015 |
| WO | D084305-005 | S | 3/2015 |
| WO | D084305-006 | S | 3/2015 |
| WO | D084305-007 | S | 3/2015 |
| WO | D084305-008 | S | 3/2015 |
| WO | D084305-009 | S | 3/2015 |
| WO | D084895-001 | S | 5/2015 |

* cited by examiner

TISSUE CARTON

BACKGROUND OF THE INVENTION

Facial tissue cartons can generally be classified as either one of two basic styles—flat cartons and upright cartons. In the case of flat cartons, folded tissue sheets are laid flat in the bottom of the carton and withdrawn through an opening in the carton top which partially extends down the front sidewall. The tissues within the flat carton may be interfolded for pop-up dispensing or merely laid on top of each other for reach-in dispensing. In the case of upright cartons, the tissues are folded into an inverted u-shaped clip and are interfolded for pop-up dispensing. The tissues are withdrawn through a dispensing opening in the top of the carton, which may contain a poly film having a slit to hold the popped up tissue in place.

While the majority of upright and flat cartons are four sided cubic structures, alternative shapes have been proposed. For example, U.S. Pat. No. 5,259,550 discloses an upright tissue carton having a decahedral prismatic configuration and U.S. Pat. No. 7,568,594 discloses an upright tissue carton having an oblong shape.

Inventors of cartons for storing and dispensing consumer goods other than tissue products have also experimented with shapes other than conventional cubes. For example, it is known to round off or chamfer certain corners of the carton to provide a distinctive appearance. This has typically been achieved in the past by providing lines of weakness, such as creasing lines or score lines, in the blank at the areas forming the edges of the container. These lines of weakness allow the blank to be folded in such a way that the corner does not sharply bend but instead progressively bends between two adjacent planar walls. The resulting cartons have a differentiated appearance and in some instances may improve handling and grasping of the carton. One such carton is disclosed in U.S. Pat. No. 6,027,016 which discloses a carton having beveled edges.

Alternatively shaped tissue dispensers to the ubiquitous cubic upright tissue cartons could offer an advantage in product differentiation. Alternatively shaped tissue dispensers could be offered as a new premium product and upright tissue dispensers as a mid-tier product. However, alternatively shaped dispensers are typically not as well suited to the size of standard tissue stacks, which often fit better and dispense better from the traditional shapes. This can significantly reduce the number of sheets that can fit into the alternatively shaped dispenser and/or cause dispensing problems (sheet tears, multiple dispensing, sheet fallback) when dispensing. Dispensing problems can cause a perception of poor quality in the mind of the user/purchaser making it more difficult to position an alternatively shaped dispenser as a premium product.

Therefore, a need exists for dispenser shapes that are significantly differentiated from existing upright or flat tissue carton shapes; yet, at the same time, can dispense tissue stacks as well or better than current upright or flat dispensers for a similar sheet count tissue stack.

SUMMARY OF THE INVENTION

The present inventors have now discovered a novel blank for producing cartons having a novel shape. The cartons are particularly well suited for storing and dispensing tissue products and may be configured for convenient pop-up dispensing. The novel cartons have at least one corner edge that is partially formed from an edge wall having a convex cross-sectional shape. In certain instances each of the carton edges is at least partially formed from an edge wall having a convex cross-sectional shape. By providing a carton having one or more convex shaped corner edges not only is a distinctive carton created, but the additional wall forming the convex edge may be provided with graphics that differ from the other carton walls to further enhance the carton's distinctive appearance.

Accordingly, in one embodiment the present invention provides a carton having at least one edge partially formed by a convex edge wall, the carton comprising a top wall, a bottom wall, a front wall having a front wall panel face, a rear wall and an edge wall having a convex cross-sectional shape, the top wall contiguous with the front wall, the front wall contiguous with the edge wall, the rear wall sealed to the top wall; a first and a second end-wall formed from a plurality of end-wall panels, each end-wall panel contiguous with a the top wall, bottom wall, front wall or rear wall; and a first edge formed between the front wall and the first end-wall, wherein at least a portion of the first edge is formed by the edge wall.

In another embodiment the present invention provides a carton comprising a top wall, a bottom wall, a front wall having an hourglass shaped front wall panel, and a rear wall; a first and a second end-wall formed from a plurality of end-wall panels, each end-wall panel contiguous with the top wall, bottom wall, front wall or rear wall; and a pair of edges formed between the front wall and the first and second end-walls, the pair of edges bounding the hourglass shaped front wall panel and comprising an edge wall having a convex cross-sectional shape.

In still other embodiments the present invention provides a carton comprising a top wall, a bottom wall, a front wall having an hourglass shaped front wall panel, and a rear wall having an hourglass shaped rear wall panel; a first and a second end-wall formed from a plurality of end-wall panels, each end-wall panel contiguous with the top wall, bottom wall, front wall or rear wall; and four vertical edges extending from the top wall to the bottom wall, each edge comprising an edge wall having a convex cross-sectional shape.

In yet other embodiments the present invention provides a carton comprising a top wall, a bottom wall, a front wall having an hourglass shaped front wall panel, and a rear wall having an hourglass shaped rear wall panel; a first and a second end-wall formed from a plurality of end-wall panels, each end-wall panel contiguous with the top wall, bottom wall, front wall or rear wall, the first and second end-walls having an hourglass shape; and four vertical edges extending from the top wall to the bottom wall, each edge comprising an edge wall defined by a pair of opposing, mirror image, symmetrical, crease lines and having a convex cross-sectional shape.

In still other embodiments the present invention provides a carton blank comprising (a) a top panel having first and second major flaps contiguous therewith and separated by first and second fold lines; (b) a front wall panel contiguous with the top panel and having first and second minor flaps contiguous therewith and separated by first and second curvilinear fold lines; (c) a bottom panel contiguous with the front wall panel and having third and fourth major flaps contiguous therewith and separated by third and fourth fold lines; at least one of the front or rear wall panels comprising a pair of opposing and symmetrical crease lines disposed thereon, the crease lines merging with one another to form first and second linear crease lines.

DETAILED DESCRIPTION OF PARTICULAR EMBODIMENTS

The present invention provides a novel carton for storing and dispensing sheet material, which includes, for example, flexible substrates useful for household chores, cleaning, personal care, health care, food wrapping, and cosmetic application or removal. In certain preferred embodiments the carton may be used to store and dispense a stack of tissue sheets, also referred to as a clip, which has been folded to facilitate pop-up dispensing of individual tissue sheets. Generally, as used herein, "tissue" refers to various paper products, such as facial tissue, bath tissue, paper towels, napkins, and the like. To facilitate pop-up dispensing the clip of tissues may be interfolded, prefolded interfolded, or non-interfolded. In a particularly preferred embodiment the clip comprises a plurality of interfolded tissue sheets and more particularly a plurality of C-folded or V-folded sheets, which upon withdrawal of the upper most sheet from the clip subsequent sheets are individually presented for individual use.

Figure 1:
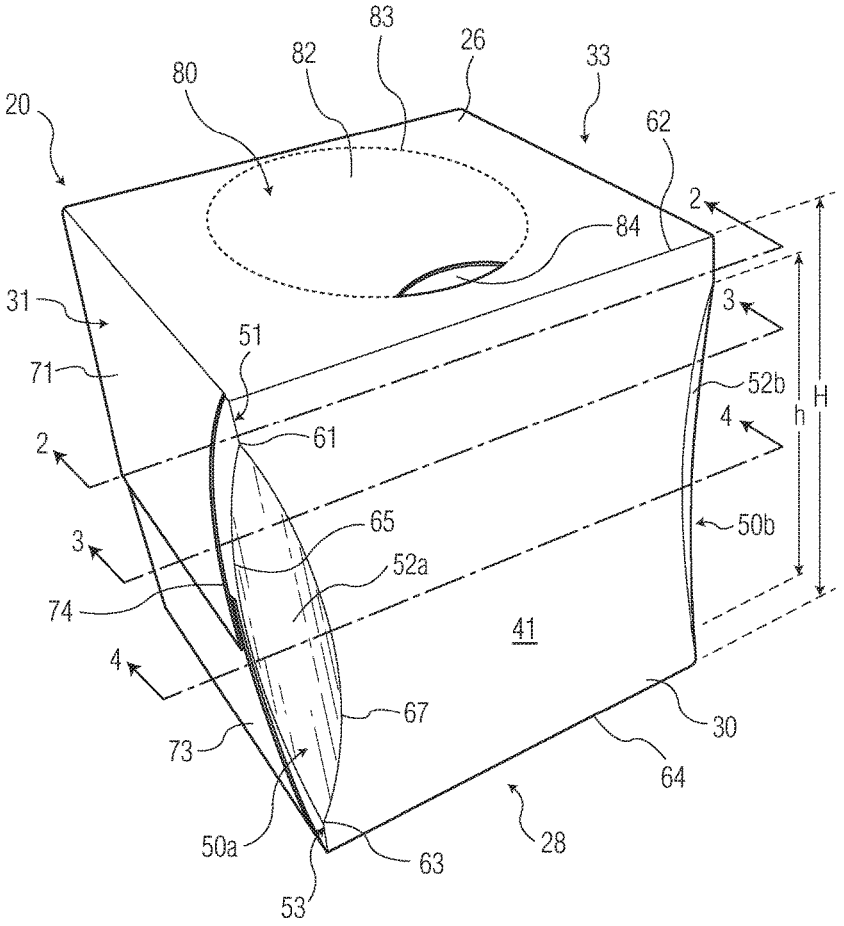
FIG. 1 a perspective view carton according to one embodiment of the present invention.

With reference now to FIG. 1, the carton 20 may be an upright dispenser for storing and dispensing sheet materials having an overall height of approximately 125 mm and a footprint or bottom of approximately 110 mm by 110 mm that form a parallelepiped having a generally cubical shape, albeit with corner edges 50 being partially convex shaped. In the illustrated embodiment, the carton 20 comprises a rectangular parallelepiped top wall 26, and opposite bottom wall (not illustrated in FIG. 1), and four sidewalls—front sidewall, rear sidewall, first end-wall and second end-wall—extending between the top and bottom walls. The sidewalls that are fully visible in FIG. 1 have been given reference numerals 30 and 31, which correspond to the front sidewall and first end-wall, respectively.

The carton 20 may be formed from a single sheet of paperboard of rectangular shape possessing four wall panels corresponding to top and bottom wall panels, respectively 26 and 28, and front and rear sidewall panels, respectively 30 and 32. While in certain embodiments the carton may be formed from paperboard the invention is not so limited and the carton may be constructed from any rigid material, for example, cardboard, carton stock, polypropylene, polyethylene, polystyrene, ABS plastic, plastic, metal, amongst other suitable alternatives.

The wall panels 26, 28, 30 and 32 are joined together through first 62, second 64 and third fold lines (not illustrated in FIG. 1). The first and second end-walls 31, 33 are formed by folding minor flaps, which extend from and are attached to the front sidewall and rear sidewall panels, respectively 30 and 32, to partially close the container's ends. The first and second end-walls 31, 33 are completed by folding the major flaps (flaps 71 and 73 illustrated in FIG. 1, major flap 75 illustrated in FIGS. 2-4) which extend from and are attached to the top and bottom wall panels, respectively 26 and 28. While it is possible to close the major flaps first and then the minor flaps second, existing cartoners would have to be rebuilt in order to change the flap opening and closing sequence.

The carton 20 has four corner edges 50, one of which is fully visible in FIG. 1 and given reference numeral 50*a* and another that is partially visible and given reference numeral 50*b*. A portion of the corner edge is formed by bending the front or rear sidewall about a crease line to form two adjacent planar walls and an edge having a substantially square cross-sectional shape. For example, the corner 50*a* comprises a first and third corner section 51, 53 which are formed by folding the front sidewall 30 about a first and second linear, substantially straight, crease line 61, 63.

In addition to having square edge sections, the carton edge also has a section having a convex cross-sectional shape. While the illustrated carton comprises four edges and each edge is at least partially formed by a convex shaped wall the invention is not so limited and the carton may comprise one convex shaped edge wall, two convex shaped edges walls, or three convex shaped edge walls. In each instance however, the convex shaped edge walls are apportioned from a carton sidewall and contiguous therewith. As shown in FIG. 1, the carton 20 has at least one of the corner edges 50*a* partially formed by a wall 52 that is apportioned from a portion of one the carton sidewalls, such as the front sidewall 30 as illustrated. The wall 52 may be formed by a pair of spaced apart crease lines 65, 67 which provide the wall 52 with a convex cross-section shape.

With continued reference to FIG. 1, the pair of convex shaped edge walls 52*a*, 52*b* (right hand wall only partially visible) flank a front wall panel 41 portion of the front sidewall 32. The curvilinear crease lines 53 defining a portion of the first and second edge walls 52 provide the front wall panel 41 with an hourglass like shape. Thus, the opposing crease lines 65, 67, which in the illustrated embodiment are symmetrical and mirror images of one another, not only form the edge wall 52 and provide it with a convex cross-sectional shape, but also provide the front wall panel 41 with a distinct shape. The crease lines 65, 67 merge with one another to form first and second linear, substantially straight, crease lines 61, 63, which further define the carton edge 50.

As further illustrated in FIG. 1 the opposing crease lines 65, 67 and the resulting wall 52 do not extend the entire height of the carton (H, extending vertically from the top wall 26 to the bottom wall 28). Rather, the wall 52 only extends along a portion of the edge 50. In certain embodiments the wall, which preferably has a convex cross-section shape, has a height (h) that is less than about 95 percent of the height (H) of the carton and more preferably less than about 90 percent, such as from about 50 to about 95 percent and more preferably from about 60 to about 90 percent and still more preferably from about 70 to about 80 percent of the height (H) of the carton.

Further, because the convex shaped wall forms only a portion of the carton edge the shape of the edge 50 varies between the edge midpoint (approximately equal vertical distance between the top wall 26 to the bottom wall 28) and the first and third edge sections. For example, the first and second edge sections 51, 53 are formed from folding a portion of the front sidewall 30 along a first substantially straight, linear crease line 61 and a second substantially straight, linear crease line 63 to form a substantially square corner. The convex shaped edge wall 52 is formed between the first and second straight crease lines 61, 63 and extends only along a portion of the carton edge 50. The convex shaped edge wall 52 is formed from a pair of spaced apart, non-linear, crease lines 65, 67 that allow the front wall 30 not to sharply bend but instead progressively bend outward. In this manner the convex shaped edge wall 52 is disposed between a pair of adjacent planar walls 30, 31 and forms a portion of the carton edge 50. Further, folding along the shaped crease lines 65, 67 causes the edge wall 52 to assume a convex shape having a variable radius of curvature. The radius of curvature of the convex edge wall is generally measured as the outer radius of curvature of the edge wall cut through the plane normal to the axis of the top wall of the carton.

Figure 2:
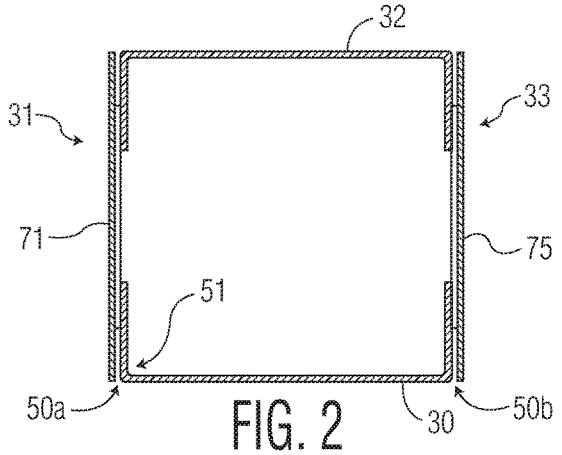
FIG. 2 is a cross section of the carton FIG. 1 through line 2-2.
Figure 3:
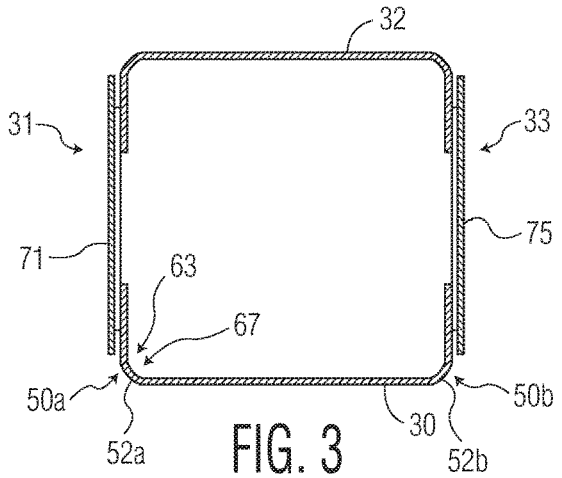
FIG. 3 is a cross section of the carton FIG. 1 through line 3-3.
Figure 4:
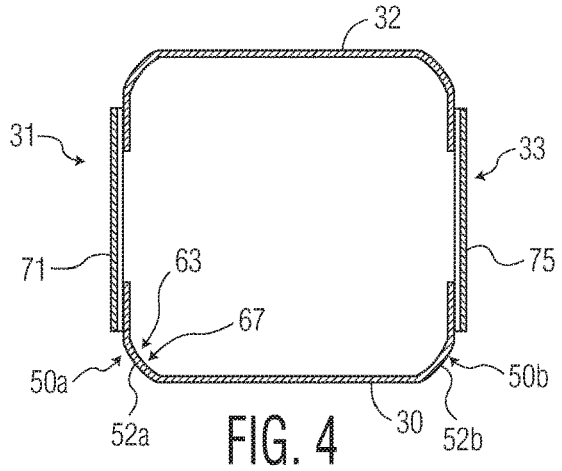
FIG. 4 is a cross section of the carton FIG. 1 through line 4-4.

With reference now to FIGS. 2-4 the shape of the carton edge 50 is illustrated in more detail. As described above, the first edge 50*a* is formed by folding a portion of the front sidewall 30 along a first crease line 51 to form a substantially square corner (shown in FIG. 2). Below the first edge end the convex edge wall 52 is formed by folding a portion of the front sidewall 30 along the crease lines 65, 67 causing the edge wall 52 to assume a convex shape having an initial radius of about 1.0 mm (shown in FIG. 3). Continuing down the carton edge 50 the radius of the convex edge wall 52 increases reaching a maximum of about 5.0 mm at approximately the edge midpoint (M) (shown in FIG. 4). Continuing down the carton edge 50 the radius of the convex edge wall 52 decreases and eventually transitions to a square edge near the second edge end. In this manner the carton edge is provided with three or more cross-sectional profiles—a substantially square edge, a first convex edge portion having a first radius of curvature and a second convex edge portion having a second radius of curvature. Generally the radius of curvature of the first convex edge portion is less than the radius of curvature of the second convex edge portion. For example, the first convex edge portion may have a radius of curvature from about 0.5 to about 2.0 mm and the second convex edge portion may have a radius of curvature from about 4.0 to about 10.0 mm.

With reference again to FIG. 1, the carton 20 further includes a dispensing opening 80 and optionally includes a dispensing window. For loading on an automated carton line, the dispensing widow should be pre-attached to the carton blank by attaching the dispensing window to either the inside or the outside of the top flap, preferably on the inside on as shown. The dispensing window can be made from a suitable sheet materials such as a film, nonwoven, or paper material that can retain a partially a dispensed sheet, such as a facial tissue, within the dispensing opening for pop-up dispensing. The dispensing window has a dispensing orifice that can be a slit; a curvilinear line; a geometric shape such as an oval, a circle, or a triangle; or X shaped, + shaped or H shaped. Alternatively, the dispensing window can be eliminated and fingers or tabs projecting into the dispensing opening 80 can be used to retain a partially dispensed sheet.

The dispensing opening 80 can be any size or shape such as square, circular, or oval. The dispensing opening can be located such that it resides entirely in one of the top flaps or the dispensing opening can be located such that a portion resides in one of the top flaps and another portion resides in one of the decorative panels. By having the dispensing opening span portions of the top flap and decorative panel, the amount of board material utilized to form the carton can be minimized. This occurs since the overall size of the top flaps can be decreased because less material is needed to surround the dispensing opening. Additionally, by having the dispensing opening span portions of the container top and decorative panel, a unitary or one piece dispensing window can be used that simplifies the overall construction of the carton and allows for maximum flexibility in choosing the shape of the dispensing orifice. By unitary it is meant that the dispensing window is a single continuous piece rather than formed from two or more pieces that meet or overlap. Because the window is unitary, any desired shape for the dispensing orifice can be cut into the window without concern of having separate pieces meet or join together to form the dispensing orifice and/or dispensing window.

The carton 20 further includes an optional removable surfboard 82 that can be attached to the top panel 26 by a perforated or weakened line 83. The removable surf board can be used to prevent foreign materials from entering the assembled container and provides protection for the more fragile dispensing window during loading and shipping. As further illustrated in FIG. 1 the surfboard 82 may also comprises a finger tab 84 to facilitate removal by a user.

The carton can also include and optional film wrapper that can span any of the panels. The film wrapper can be perforated near both ends to permit easy removal. Additionally, other sheet materials beside film can be used to construct the wrapper. The film wrapper can be used to display printed information such as a prominent trademark that can identify the manufacturer at the point of purchase, which then later can be removed by the consumer so as not to detract from the carton graphics.

Figure 5:
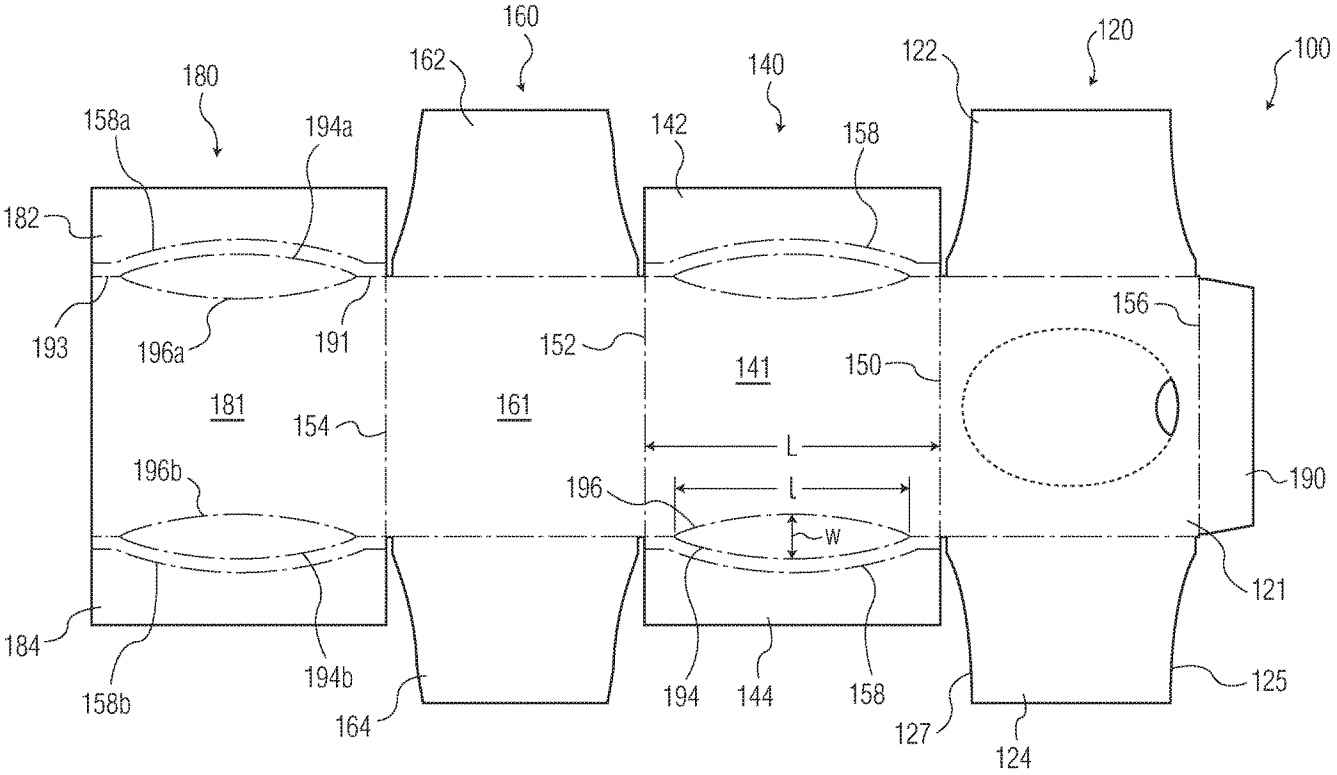
FIG. 5 is a plan view of a blank from which the instant carton may be formed.

With reference now to FIG. 5, a blank 100 useful in forming a carton of the present invention is illustrated. The blank 100 includes a first section 120 having a first panel 121 and first and second major flaps 122, 124 extending therefrom. Blank 100 further includes a second section 140 connected to first section 120 and separated therefrom by a fold line 150, the second section 140 having a second section panel 141, and first and second minor flaps 142, 144 extending therefrom. The blank 100 still further includes a third section 160 connected to second section 140 and separated therefrom by a fold line 152, the third section 160 having a third panel 161, and third and fourth major flaps 162,164 extending therefrom. The blank 100 still further includes a fourth section 180 connected to third section 160 and separated therefrom by a fold line 154. The fourth section 180 having a fourth section panel 181, and third and fourth minor flaps 182, 184 extending therefrom.

Finally, the blank 100 includes a tab 190 connected to the first panel 121. Tab 190 is utilized to secure the fourth section panel 181 to the first section panel 121 in constructing a container that can be made from the blank 100. Alternatively the tab may be disposed on the fourth panel and used to secure the fourth panel to the first panel when the blank is folded to form a carton according to the present invention.

To form the container, the blank is folded along a plurality of fold lines illustrated by the dashed line having long and short dashes. Folding along fold lines 150, 152, 154 causes the second, third and fourth section panels 141, 161, 181 to form the front and rear side walls and the bottom wall of the carton to be formed. Folding along fold line 156 and joining tab 190 to the fourth section panel 181 forms the top of the carton. Further, the flaps 122, 124, 142, 144, 162, 164, 182 and 184 may be folded to form the first and second carton sidewalls.

The carton blank 100 can be designed such that there are major flaps and minor flaps. The major flaps have a longer length than the minor flaps. In the illustrated embodiment, the major flaps are 122, 124, 162 and 164 while the minor flaps are 142, 144, 182, and 184. Alternatively, the carton can be designed such that all the flaps are approximately the same length. To minimize the carton material required, the major flaps are designed to have a length that is approximately half the width between opposing decorative panels in the assembled container. In this manner, the major flaps will just meet or slightly overlap when folded over to form either the top or the bottom of the container. While extra material can be used, such as a top or bottom flap that spans the entire end of the container, more board is needed resulting in a more expensive carton and reduced nesting of adjacent blanks during the printing and die cutting process. To further reduce the board material required, the minor flaps should be made as short as possible while still allowing for efficient opening and closing of the flaps on an automated cartoner. The minor flaps also need to be large enough such that a sufficient attachment area is present to hold the flaps in a closed and sealed position after filling the container. For improved handling on an automated cartoner, the minor flaps should have a minimum length that is approximately 40 percent the length of the major flaps and not less than about 20 mm, or less than about 25 mm, or less than about 30 mm, or less than about 35 mm. Minor flaps that are too short require special scoring during fabrication to reduce the bending forces required and also limit the seal attachment area. The minor flaps can be made as long as necessary for closing the carton, but should not be made so short as to cause problems opening and closing the flap and then sealing it shut on automated equipment.

In particularly preferred embodiments, such as that illustrated in FIG. 5, the major flaps, such as major flap 124, have curvilinear opposed side edges 125, 127, which may be folded to form a portion of the carton end-wall. The shape of the side edges may be designed to accommodate the convex shaped edge wall when the blank is folded into a carton. Further, the minor flaps, such as minor flap 142 are formed by folding along a curvilinear fold line 158 disposed between the second section panel 141 and the minor flap 142. In a particularly preferred embodiment, the major flap 124 may comprise curvilinear side edges 125, 127 having a curvature that substantially matches the curvilinear edge profile of the minor flap fold line 158. In this manner, when the minor and major flaps are folded to form the carton end-wall the profiled edge of the major flap practically or actually abuts the fold line forming the minor flap. When both major and minor flaps forming the end-wall are shaped in this manner the resulting end-wall may have an hourglass like shape. In a particularly preferred embodiment a blank is provided, such as that illustrated in FIG. 5, which when folded provides a carton having four sidewalls—a front wall, a rear wall, and first and second end-walls—all of which have an hourglass like shape.

With continued reference to FIG. 5, the second and fourth section panels 141, 181 comprise first and second straight, linear crease lines 191, 193 which terminate at a pair of opposing, mirror image, symmetrical, crease lines 194*a*, 196*a*. The pair of opposed crease lines 194*a*, 196*a* and the first and second crease lines 191, 193 are disposed adjacent to a curvilinear fold line 158*a*, which when folded forms the minor flap 182. A similar pair of crease lines 194*b*, 196*b* are disposed adjacent to a second curvilinear fold line 158*b*, which when folded forms the opposite minor flap 184. In certain embodiments the depth of the first and second crease lines 191, 193 may vary from the depth of the pair of opposed crease lines 194, 196. When the blank 100 is folded to form a carton, the first and second crease lines 191, 193 form first and third edge sections which are substantially square and the pair of opposed crease lines 194, 196 form an edge wall having a convex cross-sectional shape.

The dimensions of the opposed crease lines forming the convex carton corner edge wall may vary depending on the desired shape of the corner edge and the size of the carton. In certain embodiments, such as that illustrated in FIG. 5, the blank 100 may be provided with a pair of opposing, mirror image, symmetrical, crease lines 194, 196 having a length (I) and a width (w), where the width is the widest distance between the opposing crease lines, the length (I) ranging from about 8.0 to about 12.0 cm, and the width ranging from about 1.0 to about 2.0 cm. In other embodiments the wall panel, such as second panel 141, may have a length (L) and the length (I) of the pair of opposing, mirror image, symmetrical, crease lines may be from about 50 to about 95 percent of the length (L), such as from about 60 to about 90 percent and more preferably from about 70 to about 80 percent.

In certain instances the convex edges may be combined with uniquely shaped wall panels to form a carton display face that may be printed with different graphics to provide a carton having unique visual appeal and a distinctive appearance on shelf. For example, with reference to FIG. 6, a plurality of cartons 220*a*-220*d* may be stacked and overwrapped with film 240 to form a bundle of cartons 200. Each of the cartons 220*a*-220*d* may comprise a display face 260, which includes a framing region 262, defined by the convex edge portions 265 and a focal region 264, defined by the folded major flaps 267, 269 having first and second curvilinear edge portions 271, 273. The framing region may have a framing pattern printed thereon and the focal region may have a focal pattern printed thereon where the framing pattern and focal pattern are visibly perceptibly different. Thus, in a preferred embodiment, the framing region is visually distinct from the focal region.

In certain embodiments the framing pattern comprises a first shade and the focal area comprises a second shade where the second shade is different, either in lightness, darkness, and/or color, from the first shade. The multi-shades operate to further enhance the appearance of depth and edge definition to a user viewing one of the carton sidewalls. In one embodiment herein, the framing region comprises a first color shade that is darker than the second shade of the color of the focal region. Alternatively, the framing region comprises a first shade that is lighter than the second shade of the color of the focal region.

Another way of creating visual contrast between the framing region and the focal region is by utilizing different print colors having different L* values in the framing region as compared to the focal region. In various embodiments, the focal region may have a background color. Likewise, the framing region may have a background color. Each background color has an L* value that can be measured by any suitable imaging software program as discussed herein. The L* scale ranges from 0 (black) to 100 (white). The L* values are determined from the perspective of the user using ADOBE Photoshop CS5 Extended software (version 12.0 x64, Lab Mode, CIELAB D50), the difference between the lowest L* value measured for the background color in the framing region and the lowest L* value measured for the background color in the focal region may be at least 5, at least 10, at least 15, or at least 20. In various embodiments, the lowest L* value measured for the background color in the focal region is less than the lowest L* value measured for the background color in the framing region. In some embodiments, the background color in the focal region may have a lowest L* value of no more than 20, 25, 30, 35, 40, 45, or 50. In some embodiments, the background color in the framing region may have a lowest L* value of at least 30, 35, 40, 45, 50, 55, 60, 65, or at least 70. In a specific embodiment, the background color in the framing region may have a lowest L* value of about 50 and the background color of the focal region may have a lowest L* value of about 15. In various embodiments, the difference in the lowest L* value for the background color of the framing region on the convex wall and the lowest L* value for the background color of the focal region on the front wall panel face may be at least 10, at least 15, or at least 20.

While not wishing to be bound by theory, it is believed that having a framing region with a different shade highlights or draws the attention of the consumer to the focal region like a picture frame to a picture. It is further believed that the contrast in shades between the framing region and the focal region helps quickly draw the consumer's eye to the focal region which is usually near the center of the package. It is also believed that differing the shading of the framing region from the focal region draws the consumer's attention to the focal region and focuses attention on the key customer communications such as branding and navigation.

Figure 6:
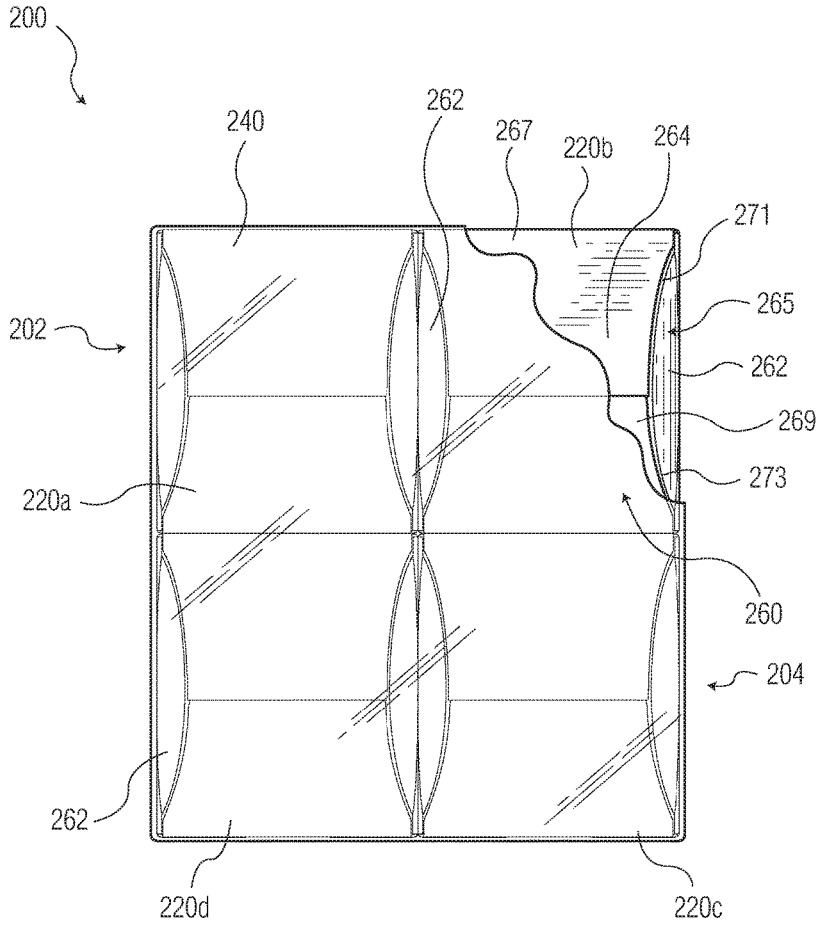
FIG. 6 is a front view of an overwrapped stack of cartons according to the present invention.
Figure 7:
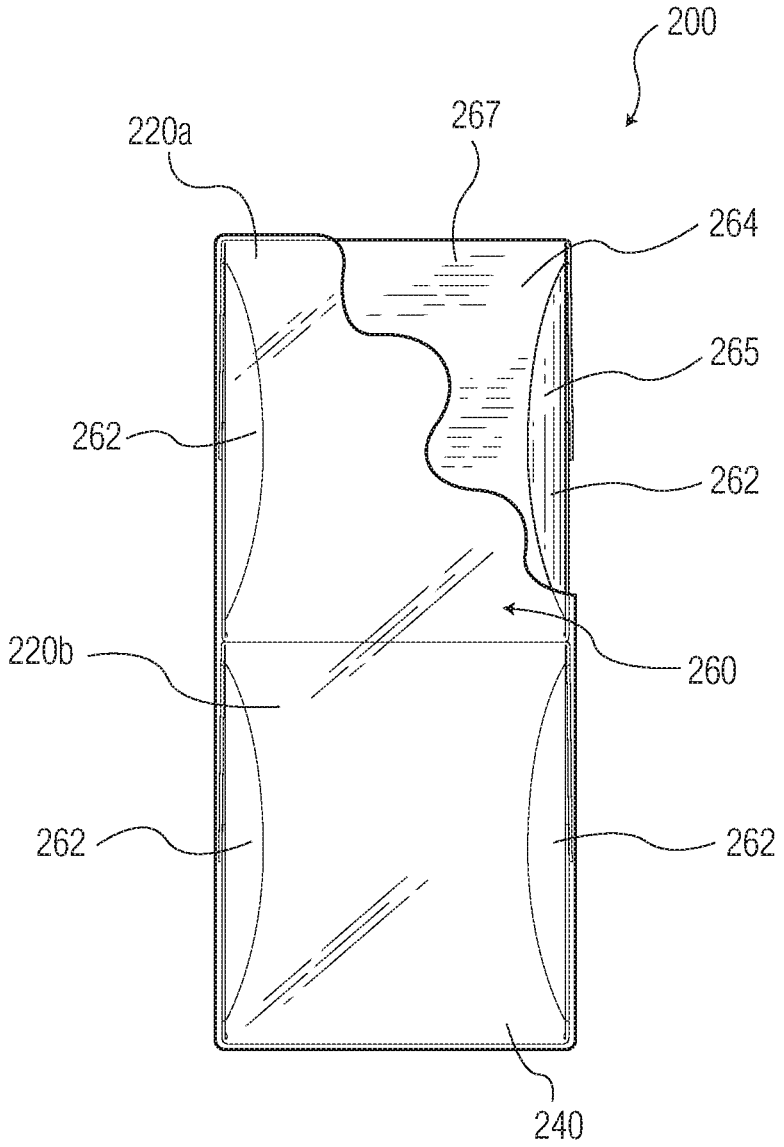
FIG. 7 is a side elevation view of an overwrapped stack of cartons according to the present invention.
Figure 8:
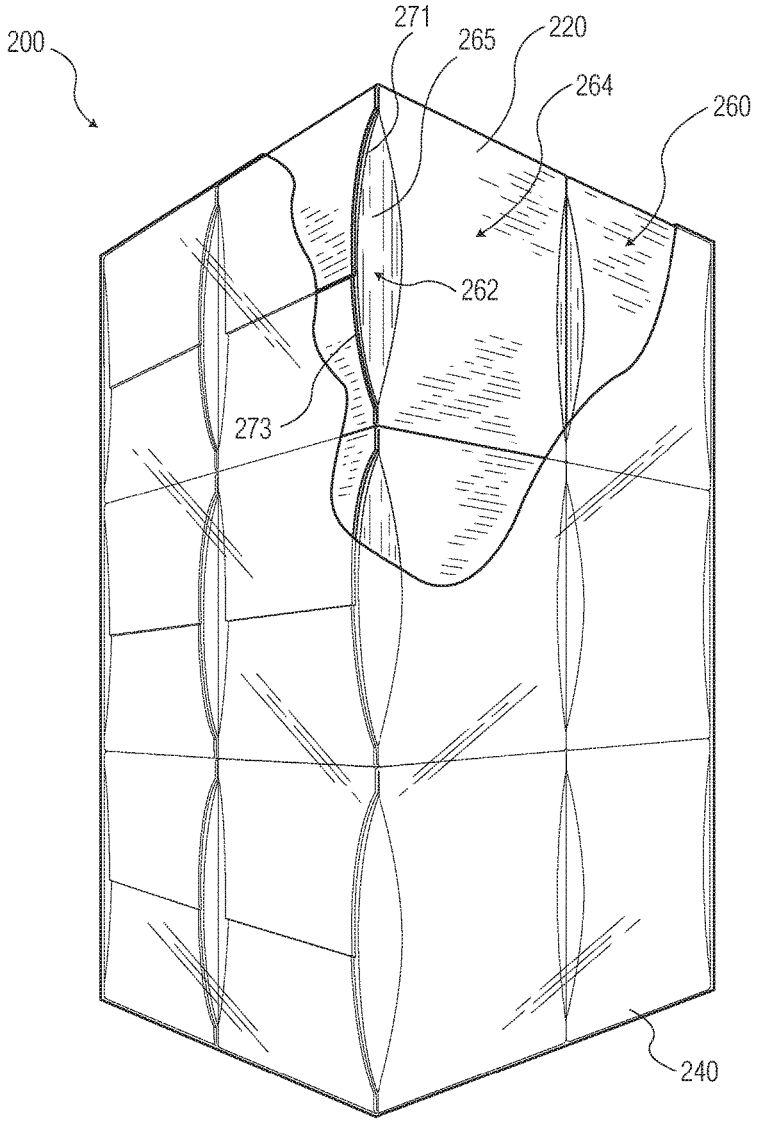
FIG. 8 is a perspective view of an overwrapped stack of cartons according to the present invention.

The cartons of the present invention may be combined with similar cartons and overwrapped with a plastic film for storage and display on a store shelf. Exemplary bundles of cartons are illustrated in FIGS. 6-8. For example, as illustrated in FIG. 6, four cartons 220*a*-220*d*, each having first and second convex edge walls 262, may be arranged such that the convex edge walls of adjacent cartons are disposed near one another. Arranging the cartons in this manner results in the first and second sides 202, 204 of the bundle 200 to be formed at least partially by the convex edge walls 262. Further, when each individual carton comprises four corners and each of the four corners, at least partially, comprises a convex wall the convex walls may be aligned and displayed on each facing of the bundle. In this manner bundles of cartons may be displayed on a store shelf to create a visually distinct appearance where the convex walls form framing regions and the unfolded sidewall panels form focal regions and the bundled packages have similar framing and focal regions.

The bundles of packaged goods described above may be arranged in an array. The array of bundled packaged goods may be displayed on a shelf at a point of sale, such as within a retail store, in such a way that the different products within the array are visible to a consumer and facilitate the consumer's decision making process. In a particularly preferred embodiment bundles comprising different packaged goods, such as packages of tissue products having different physical properties may be arranged in an array. In one embodiment the array may comprise bundles of packaged tissue products where each bundle comprises tissue products having at least one physical property that is different than the other bundled tissue products. For example, an array may comprise three bundles wherein the first bundle comprises tissue products having at least one physical property that is different from the second tissue product housed within the second bundle and the third tissue product housed in the third bundle. The dominant physical property of the first tissue product compared to the second and third tissue products is communicated to a consumer by selecting a background color for the carton frame region and focal region compared to that of the cartons in the second and third bundles. The background colors of the frame and focal regions is preferably matched to the sentiment of a consumer that is evoked by the dominant physical property of the packaged good.

In this manner, different background colors may be applied to the frame and focal regions of a carton may be applied to an array of packaged goods to communicate to a consumer the differences in the goods. For example, a first bundle of cartons may contain tissue product having a superior balance of softness and tensile strength, the second bundle may comprise cartons containing a tissue product comprising a lotion additive, and the third bundle may comprise cartons containing a tissue product having superior softness. Because the physical properties of the bundled packaged goods differ, the background color for each of the frames and focal regions differ amongst the bundles and are selected such that each color corresponds to the physical properties of the packaged good—purple to convey comfort of balancing strength and softness, blue to convey the presence of a lotion and a green to convey superior softness.

While the invention has been described in detail in the foregoing description, those skilled in the art will appreciate that the present invention may be embodied in any one of several different embodiments including, for example:

In a first embodiment the present invention provides a carton having at least one convex edge wall, comprising: a top wall, a bottom wall, a front wall having a front wall panel face, a rear wall and an edge wall having a convex cross-sectional shape, the top wall contiguous with the front wall, the front wall contiguous with the edge wall, the rear wall sealed to the top wall; a first and a second end-wall formed from a plurality of end-wall panels, each end-wall panel contiguous with a the top wall, bottom wall, front wall or rear wall; and a first edge formed between the front wall and the first end-wall, wherein at least a portion of the first edge is formed by the edge wall.

In a second embodiment the present invention provides the carton of the first embodiment wherein the first edge has a first edge section having a substantially square cross-sectional shape, a second edge section having a convex cross-sectional shape and a third edge section having a substantially square cross-sectional shape, the second edge section disposed between the first and third edge sections.

In a third embodiment the present invention provides the carton of the first or the second embodiments wherein one of the end wall panels is contiguous with the front wall panel and separated therefrom by an end wall panel fold line and the first and third edge sections are formed by substantially straight, linear edge crease lines disposed on the front wall panel between the front wall panel face and the end wall panel fold line.

In a fourth embodiment the present invention provides the carton of any one of the first through third embodiments wherein one of the end wall panels is contiguous with the front wall panel and separated therefrom by an end wall panel fold line and the edge wall is defined by a pair of opposing crease lines disposed on the front wall panel between the front wall panel face and the end wall panel fold line.

In a fifth embodiment the present invention provides the carton of any one of the first through fourth embodiments wherein the edge wall is defined by a pair of opposing crease lines, which are symmetrical and mirror images of one another.

In a sixth embodiment the present invention provides the carton of any one of the first through fifth embodiments wherein the carton has a height (H) and the edge wall has a height (h) which is from about 50 to about 95 percent of H.

In a seventh embodiment the present invention provides the carton of any one of the first through sixth embodiments wherein the edge wall comprises a first convex edge portion having a first radius of curvature and a second convex edge portion having a second radius of curvature, wherein the second radius of curvature is greater than the first radius of curvature. In certain embodiments the first radius of curvature is from about 0.5 to about 2.0 mm and the second radius of curvature is from about 4.0 to about 10.0 mm.

In an eighth embodiment the present invention provides the carton of any one of the first through seventh embodiments wherein the carton comprises a first, a second, a third and a fourth edge wall having a convex cross-sectional shape. In certain embodiments the first, second, third and fourth edge walls are similarly shaped and have a convex cross-section with a maximum radius of curvature from about 4.0 to about 10.0 mm.

In a ninth embodiment the present invention provides the carton of any one of the first through eighth embodiments further comprising a plurality of folded tissue sheets disposed within the carton.

In a tenth embodiment the present invention provides a carton blank comprising (a) a top panel having first and second major flaps contiguous therewith and separated by first and second fold lines; (b) a front wall panel contiguous with the top panel and having first and second minor flaps contiguous therewith and separated by first and second curvilinear fold lines; (c) a bottom panel contiguous with the front wall panel and having third and fourth major flaps contiguous therewith and separated by third and fourth fold lines; at least one of the front or rear wall panels comprising a pair of opposing and symmetrical crease lines disposed thereon, the crease lines merging with one another to form first and second linear crease lines.

In an eleventh embodiment the present invention provides the blank of the tenth embodiment further comprising a pair of opposing crease lines disposed on the front wall panel between the front wall panel face and the end wall panel fold line. In certain embodiments the opposing crease lines are symmetrical and mirror images of one another. In other embodiments the opposing crease lines merge with one another to form first and second straight, linear crease lines that may be folded to form substantially square carton edges.

What is claimed is:

1. A carton having at least one convex edge wall, comprising:

a) a top wall, a bottom wall, a front wall having a front wall panel face, a rear wall and an edge wall having a first convex edge portion having a first radius of curvature and a second convex edge portion having a second radius of curvature, wherein the second radius of curvature is greater than the first radius of curvature, the top wall contiguous with the front wall, the front wall contiguous with the edge wall, the rear wall sealed to the top wall;

b) a first and a second end-wall formed from a plurality of end-wall panels, each end-wall panel contiguous with the top wall, bottom wall, front wall or rear wall; and c) a first edge formed between the front wall and the first end-wall, wherein at least a portion of the first edge is formed by the edge wall.

2. The carton of claim 1 wherein the first edge has a first edge section having a substantially square cross-sectional shape, a second edge section having a convex cross-sectional shape and a third edge section having a substantially square cross-sectional shape, the second edge section disposed between the first and third edge sections.

3. The carton of claim 2 wherein one of the end wall panels is contiguous with the front wall panel and separated therefrom by an end wall panel fold line and the first and third edge sections are formed by substantially straight, linear edge crease lines disposed on the front wall panel between the front wall panel face and the end wall panel fold line.

4. The carton of claim 1 wherein one of the end wall panels is contiguous with the front wall panel and separated therefrom by an end wall panel fold line and the edge wall is defined by a pair of opposing crease lines disposed on the front wall panel between the front wall panel face and the end wall panel fold line.

5. The carton of claim 4 wherein the pair of opposing crease lines are symmetrical and mirror images of one another.

6. The carton of claim 4 wherein opposing crease lines are spaced apart from one another a maximum distance from about 0.5 to about 2.0 mm.

7. The carton of claim 4 wherein the end wall panel fold line is curvilinear.

8. The carton of claim 1 wherein the carton has a height (H) and the edge wall has a height (h) which is from about 50 to about 95 percent of H.

9. The carton of claim 1 wherein the first radius of curvature is from about 0.5 to about 2.0 mm and the second radius of curvature is from about 4.0 to about 10.0 mm.

10. The carton of claim 1 wherein the carton comprises a first, a second, a third and a fourth edge wall having a convex cross-sectional shape.

11. The carton of claim 10 wherein the first, second, third and fourth edge walls have a maximum radius of curvature from about 4.0 to about 10.0 mm.

12. The carton of claim 11 wherein the maximum radius of curvature is substantially equal amongst the first, second, third and fourth edge walls.

13. A carton comprising:

a) a top wall, a bottom wall, a front wall having an hourglass shaped front wall panel, and a rear wall;

b) a first and a second end-wall formed from a plurality of end-wall panels, each end-wall panel contiguous with the top wall, bottom wall, front wall or rear wall; and c) a pair of edges formed between the front wall and the first and second end-walls, each edge comprising an edge wall having a first convex edge portion having a first radius of curvature and a second convex edge portion having a second radius of curvature, wherein the second radius of curvature is greater than the first radius of curvature.

14. The carton of claim 13 wherein the hourglass shaped front wall panel defines a focal region having a first print color and the edge walls defining a framing region having a second print color, wherein the first and second print colors are different.

15. The carton of claim 14 wherein the focal region has a lowest L* value from about 20 to 40 and the framing region has a lowest L* value from 40 to about 60 and the lowest L* value of the focal region is less than the lowest L* value of the framing region.

16. An upright tissue carton for dispensing tissue sheets in a pop-up fashion, the carton comprising a top wall having a dispensing opening disposed thereon, a bottom wall, a front wall having an hourglass shaped front wall panel, and a rear wall having an hourglass shaped rear wall panel; a first and a second end-wall formed from a plurality of end-wall panels, each end-wall panel contiguous with the top wall, bottom wall, front wall or rear wall, the first and second end-walls having an hourglass shape; and four vertical edges extending from the top wall to the bottom wall, each edge comprising an edge wall defined by a pair of opposing, mirror image, symmetrical, crease lines and having a first convex edge portion having a first radius of curvature and a second convex edge portion having a second radius of curvature, wherein the second radius of curvature is greater than the first radius of curvature, and a plurality of interfolded tissues sheets configured for pop-up dispensing disposed within the carton.

17. The carton of claim 16 wherein the hourglass shaped front and rear wall panels define focal regions having a first print color and the edge walls define framing regions having a second print color, wherein the first and second print colors are different.

18. The carton of claim 16 wherein the focal region has a lowest L* value from about 20 to 40 and the framing region has a lowest L* value from 40 to about 60 and the lowest L* value of the focal region is less than the lowest L* value of the framing region.

* * * * *